US010683152B2

(12) United States Patent
Larsen

(10) Patent No.: US 10,683,152 B2
(45) **Date of Patent: *Jun. 16, 2020**

(54) FOLD OPEN FACE SEAL PACKAGE

(71) Applicant: Sonoco Development, Inc., Hartsville, SC (US)

(72) Inventor: Dave Larsen, DeKalb, IL (US)

(73) Assignee: Sonoco Development, Inc., Hartsville, SC (US)

( * ) Notice: Subject to any disclaimer, the term of this patent is extended or adjusted under 35 U.S.C. 154(b) by 84 days.

This patent is subject to a terminal disclaimer.

(21) Appl. No.: 15/980,878

(22) Filed: May 16, 2018

(65) Prior Publication Data

US 2018/0257837 A1 Sep. 13, 2018

Related U.S. Application Data

(62) Division of application No. 14/963,463, filed on Dec. 9, 2015, now Pat. No. 10,221,000.

(51) Int. Cl.
*B65D 75/58* (2006.01)
*B65D 75/36* (2006.01)

(52) U.S. Cl.
CPC ..... *B65D 75/585* (2013.01); *B65D 75/366* (2013.01); *B65D 2585/88* (2013.01)

(58) Field of Classification Search
CPC .... B65D 75/585; B65D 75/366; B65D 75/56; B65D 75/527; B65D 75/52; B65D 2585/88; B65D 73/00; B65D 73/0092; B65D 2575/365–368; B65D 2575/586
USPC ..... 206/469, 470
See application file for complete search history.

(56) References Cited

U.S. PATENT DOCUMENTS

| | | | | |
|---|---|---|---|---|
| 3,581,885 | A * | 6/1971 | Wald | B65D 75/366 206/470 |
| 3,666,087 | A * | 5/1972 | Cooper | B65D 75/322 206/470 |
| 4,106,621 | A * | 8/1978 | Sorenson | A61M 5/002 206/365 |
| 4,155,454 | A | 5/1979 | Ryden | |
| 4,210,239 | A * | 7/1980 | Takahashi | B65D 83/02 206/382 |
| 5,209,354 | A * | 5/1993 | Thornhill | B65D 43/163 206/461 |
| 5,579,910 | A | 12/1996 | Bennett | |
| 5,826,737 | A | 10/1998 | Zakensberg | |
| 5,899,333 | A | 5/1999 | Williams et al. | |
| 6,016,914 | A | 1/2000 | Gustafson | |
| 8,225,932 | B2 * | 7/2012 | Burattini | B65D 75/28 206/469 |
| 2002/0185401 | A1 | 12/2002 | Duquet et al. | |
| 2006/0042986 | A1 | 3/2006 | Simkowski | |
| 2006/0131208 | A1 | 6/2006 | Morrison | |

(Continued)

*Primary Examiner* — Robert Poon
(74) *Attorney, Agent, or Firm* — Miller, Matthias & Hull LLP

(57) ABSTRACT

A fold open face seal package is provided. The package may comprise a one or two-piece thermoformed blister adhered to a backing card. In the one piece embodiment upper and lower portions of the blister are connected by one or more hinges. In the two-piece embodiment the blister is cut into upper and lower pieces which are adhered to the backing card. The package may be opened by folding the backing card back along a bend line and then reclosed for later use.

13 Claims, 12 Drawing Sheets

(56) References Cited

U.S. PATENT DOCUMENTS

| | | | |
|---|---|---|---|
| 2010/0116772 | A1 | 5/2010 | Guo Hua Qiu |
| 2012/0205761 | A1 | 8/2012 | Shackford |
| 2013/0134066 | A1 | 5/2013 | Marcinkowski |

* cited by examiner

FOLD OPEN FACE SEAL PACKAGE

CROSS REFERENCE TO RELATED APPLICATION

This application is a divisional of U.S. patent application Ser. No. 14/963,463, filed Dec. 9, 2015. U.S. application Ser. No. 14/963,463 is incorporated here by reference in its entirety to provide continuity of disclosure.

BACKGROUND OF THE INVENTION

Field of the Invention

This disclosure relates to a fold open face seal package. More particularly, this disclosure relates to a package in which a thermoformed blister is sealed to the face of a backing card. The package can be opened by folding back the backing card which then can be bent back to reclose the package.

Description of the Related Art

There are few or no thermoformed blister packages on the market that are inexpensive, easy to open, recloseable and tamper evident. Current thermoformed packages on the market have some, but usually not all, of the above qualities.

The most common type of thermoformed package comprises a blister adhered to a perforated backing card. This kind of package is used to package articles such as razor blades and toothbrushes. The package is inexpensive and tamper evident but it is not very easy to open. Perforated cuts in the backing cards seldom work as intended, and even when they do it is difficult to remove the product through the restrictive opening in the card.

A thermoformed blister package with an unperforated card is even harder to open and can only be opened by damaging the package.

More elaborate clamshells, bi-folds and multi-piece packages can be easier to open and even made to be tamper evident and reusable, but their elaborate designs and excess plastic make them expensive to produce.

Batteries are one kind of product often packaged in thermoformed blister packages. When a consumer buys batteries in a blister package, the consumer wants to quickly open the package, remove a battery or two, place them in a device and store the package with the remaining batteries for future use. The consumer does not want to pay extra for this convenience, and the retailer does not want the package to be so easy to open that the consumer can remove the batteries from the package and leave the package in the store.

The present disclosure is designed to address the problems described above.

BRIEF SUMMARY OF THE INVENTION

The present disclosure relates to a fold open face seal package. The package may comprise a one or two-piece blister adhered to a backing card. In the one piece embodiment upper and lower portions of the blister are connected by one or more hinges. In the two-piece embodiment the blister is cut into upper and lower pieces which form an enclosure when adhered to the backing card. The blister may be made of plastic or any suitable material. The backing card may be made of paperboard or any suitable material.

The package is designed to provide easy access to the packaged articles. The package may be opened by folding the backing card back along a bend line, and then reclosed for later use. The package may be made more sound and tamper proof by incorporating small discontinuities in the cutline. The package also is designed to minimize or eliminate interference between the blister and the packaged articles when the blister is rotated backward over the top of the articles.

In one embodiment the package comprises a one piece blister and a backing card defining an interior for holding articles. The backing card has a front surface, two side edges and a bend line. The bend line divides the backing card into a card upper portion and a card lower portion and defines an axis of rotation and a first horizontal plane. The blister comprises a body and a flange extending laterally from a periphery of the body. The flange has a width and comprises hinges located in the first horizontal plane. The blister has a contoured cutline extending between two end points which are located on the flange within the first horizontal plane. The cutline comprises a portion extending across the body below the first horizontal plane. The cutline divides the blister into a blister upper portion and a blister lower portion and the flange into a flange upper portion and a flange lower portion. The flange upper portion is adhered to the card upper portion and the flange lower portion is adhered to the card lower portion. The backing card, and thus the package, is bendable along the bend line between a planar closed position and a folded open position that provides access to the articles. The package may have an unopened configuration in which the body comprises small discontinuities along the cutline that stabilize the package and also function as a tamper evidence feature.

In another embodiment the package comprises a one piece blister and a backing card wherein the blister has a planar cutline perpendicular to the card. The backing card has a front surface, two side edges and a bend line. The bend line divides the backing card into a card upper portion and a card lower portion and defines an axis of rotation and a first horizontal plane. The blister comprises a body and a flange extending laterally away from a periphery of the body. The planar cutline lies within the first horizontal plane and divides the blister into a blister upper portion and a blister lower portion and divides the flange into a flange upper portion and a flange lower portion. The flange has a width and comprises hinges located in the first horizontal plane. The blister and the backing card define an interior for holding one or more the articles. The flange upper portion is adhered to the card upper portion and the flange lower portion is adhered to the card lower portion. The package is bendable along the bend line between a planar closed position and a folded open position that provides access to the articles. The blister body may comprise a domed area.

In another embodiment the package comprises a two piece blister comprising an upper piece and a separate lower piece affixed to a common backing card, preferably in overlapping fashion. The backing card has a bend line defining an axis of rotation and a first horizontal plane. The bend line divides the card into a card upper portion and a card lower portion. The blister upper piece is affixed to the card upper portion and the lower piece is affixed to the card lower portion. The top edge of the blister lower piece is located below the bend line but preferably above the bottom edge of the blister upper piece. The upper flange may include downwardly extending areas located below the bend line that are releasably adhered to the backing card.

In all embodiments the blister body may conform to the shape of the packaged articles. However, the blister body may be any suitable shape as long as it does not unduly restrict the removal of the articles from the opened package. Amorphous shapes and rectilinear shapes may be used. Contouring the blister to the shape of the articles is not necessary for bulk packaging. Contouring the blister to non-bulk packaged articles need only be done at certain strategic locations. For example, if the packaged article is an action figure, the action figure could be packaged in a hemispherical blister that traps the action figure against the card and contacts the figure at only about four points.

DETAILED DESCRIPTION OF THE INVENTION

Figure 1:
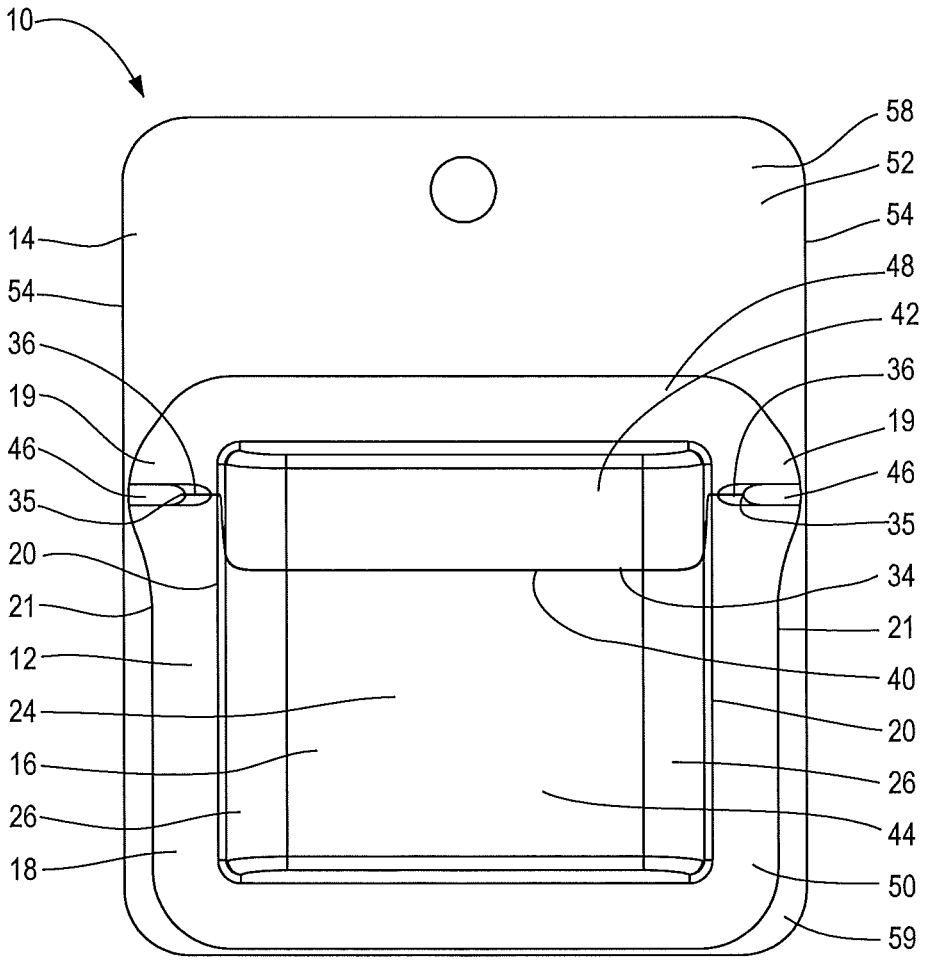
FIG. 1 is a front plan view of a first embodiment of a package according to the disclosure.
Figure 2:
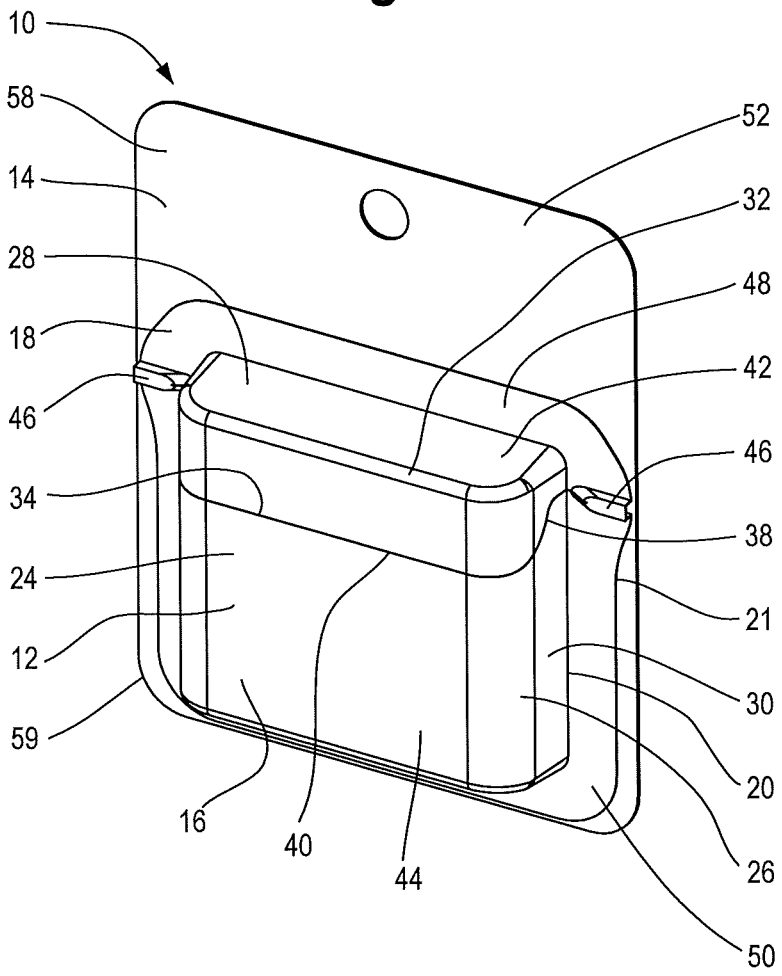
FIG. 2 is a perspective view of the package of FIG. 1.
Figure 3:
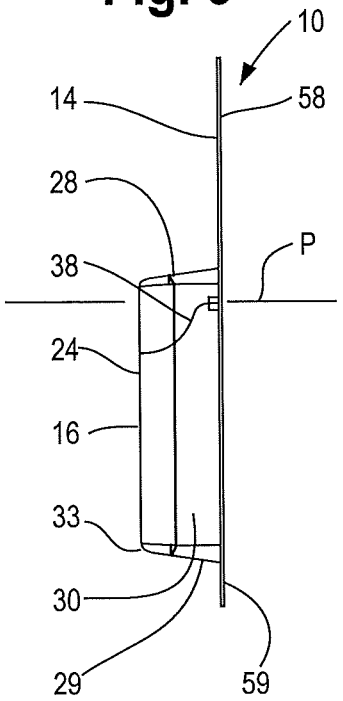
FIG. 3 is a right side view of the package of FIG. 1.
Figure 4:
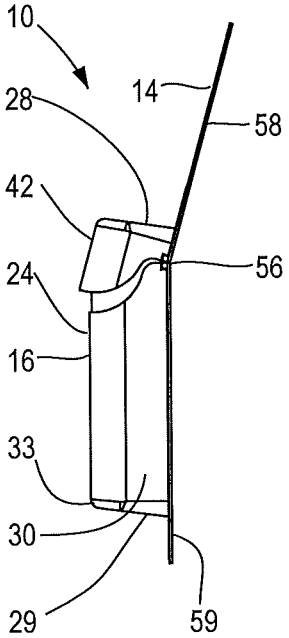
FIG. 4 is a right side view of the package of FIG. 1 shown in a partially opened position.
Figure 5:
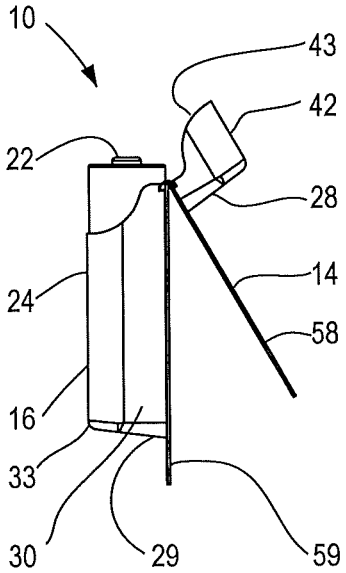
FIG. 5 is a right side view of the package of FIG. 1 shown in an open position.
Figure 6:
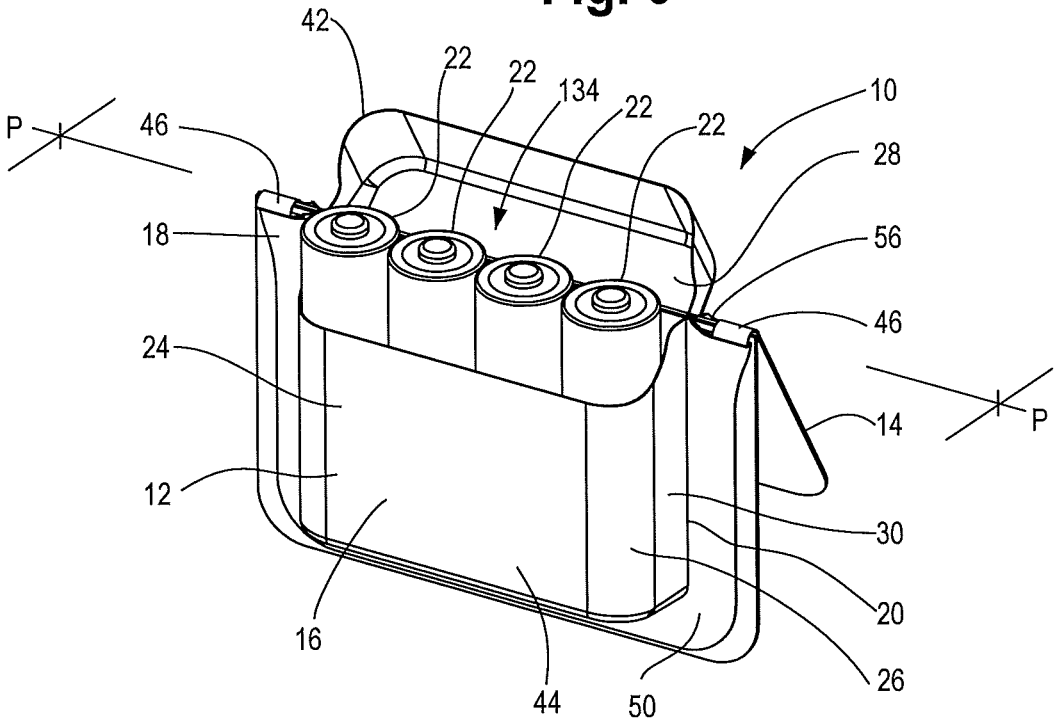
FIG. 6 is a perspective view of the package of FIG. 5.
Figure 7:
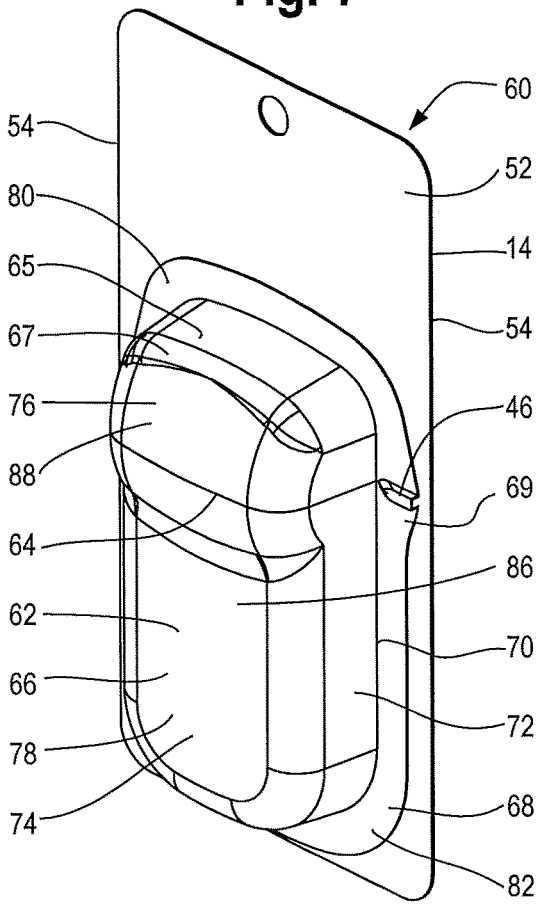
FIG. 7 is a perspective view of a second embodiment of a package according to the disclosure.
Figure 8:
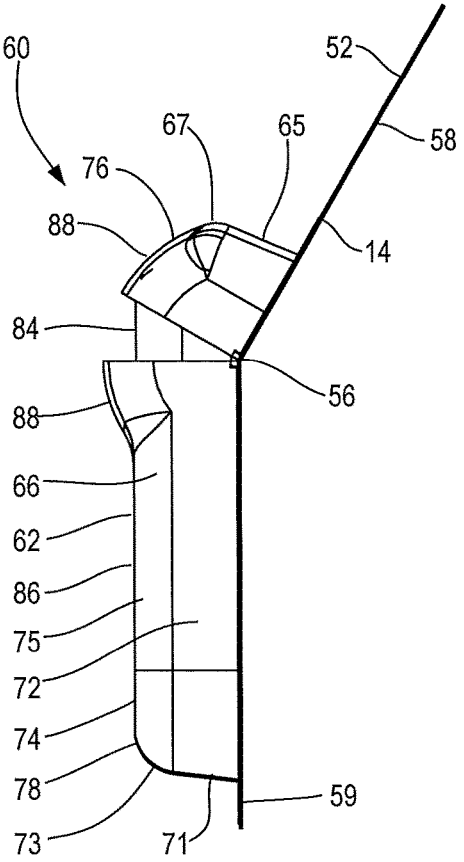
FIG. 8 is a right side view of the package of FIG. 7 shown in a partially opened position.
Figure 9:
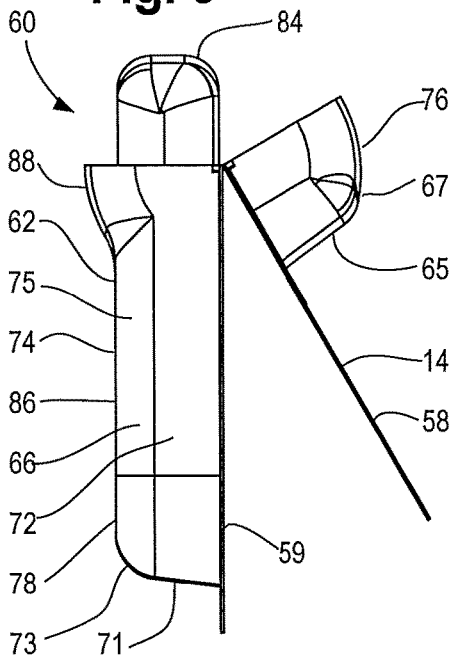
FIG. 9 is a right side view of the package of FIG. 7 shown in an open position.
Figure 10:
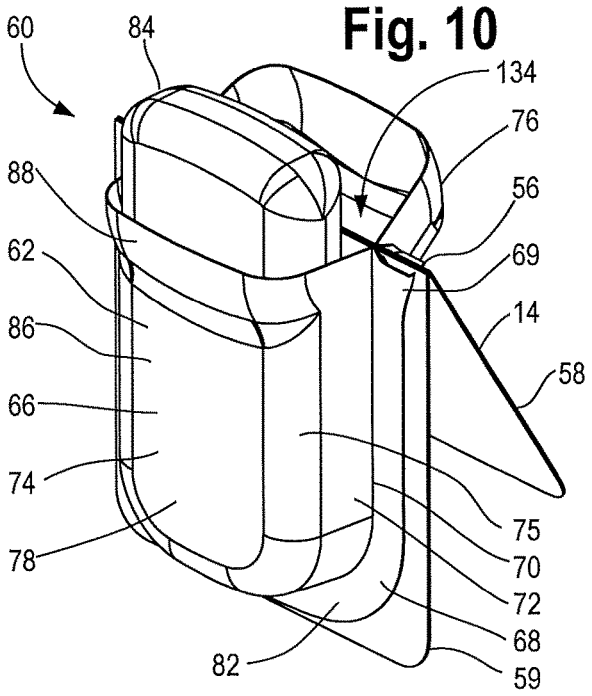
FIG. 10 is a perspective view of the package of FIG. 9.

While the invention described herein may be embodied in many forms, there is shown in the drawings and will herein be described in detail one or more embodiments with the understanding that this disclosure is to be considered an exemplification of the principles of the invention and is not intended to limit the disclosure to the illustrated embodiments.

Figure 11:
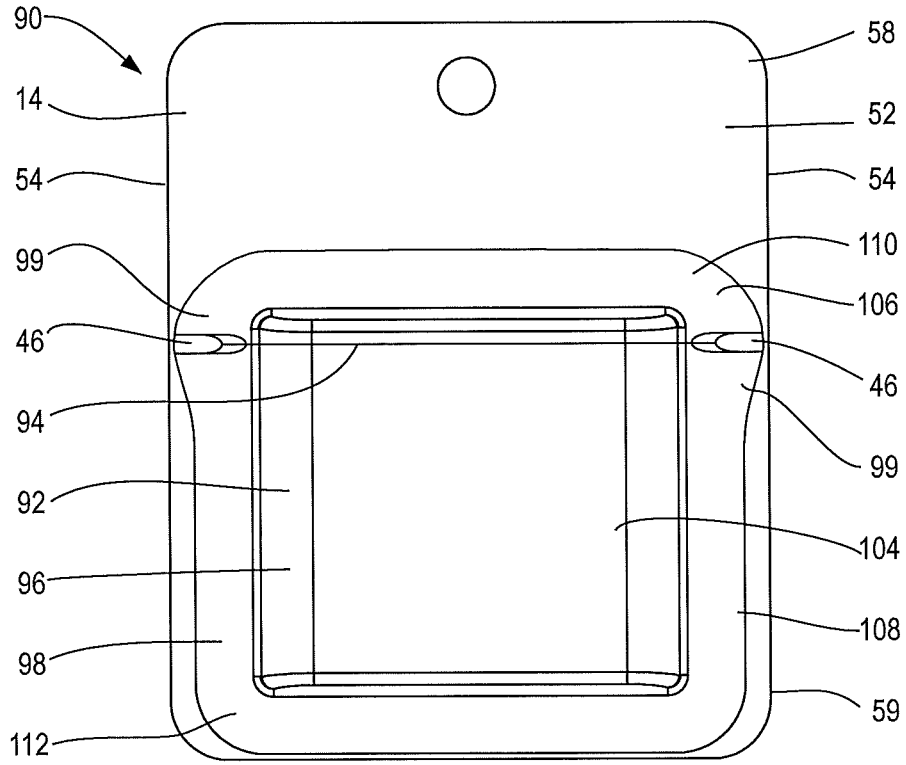
FIG. 11 is a front plan view of a third embodiment of a package according to the disclosure.
Figure 12:
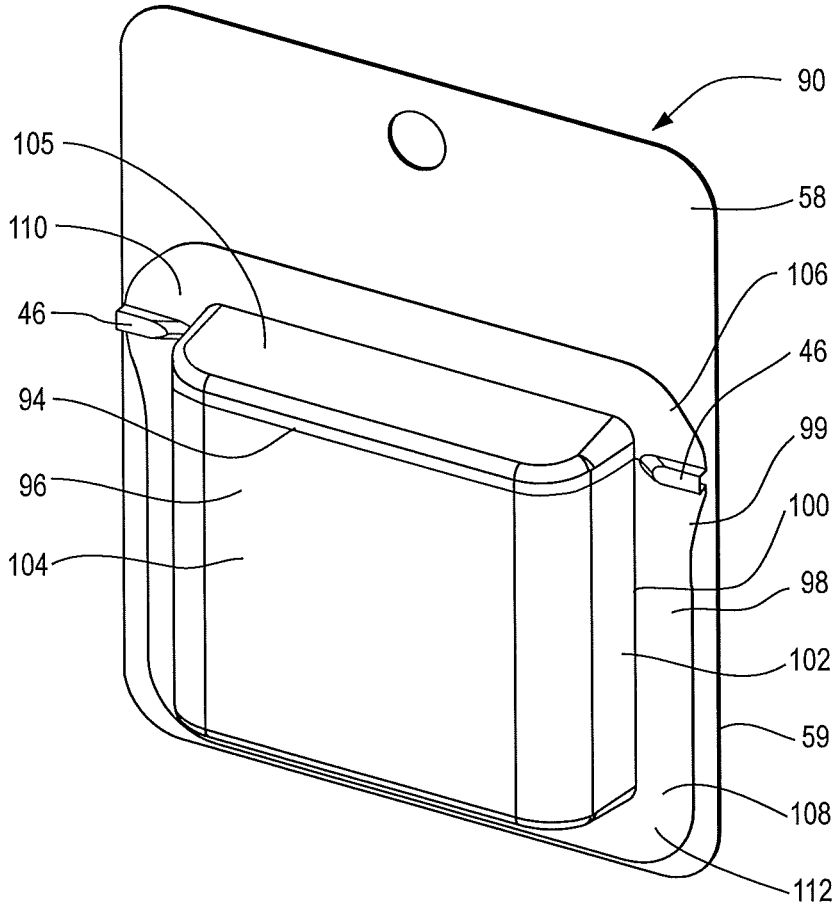
FIG. 12 is a perspective view of the package of FIG. 11.
Figure 13:
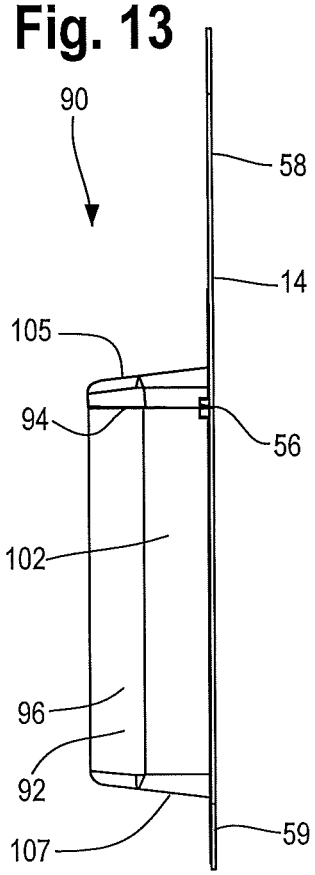
FIG. 13 is a right side view of the package of FIG. 11.
Figure 14:
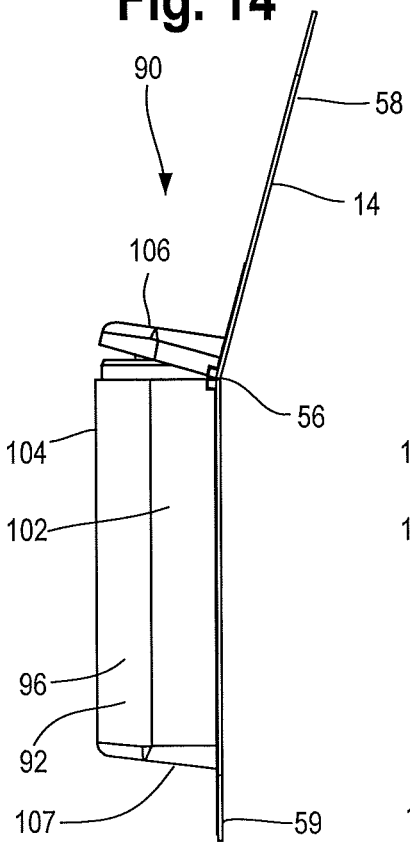
FIG. 14 is a right side view of the package of FIG. 11 shown in a partially opened position.
Figure 15:
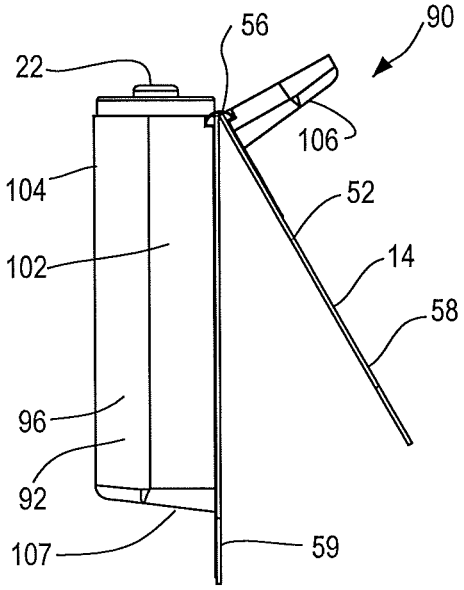
FIG. 15 is a right side view of the package of FIG. 11 shown in the open position.
Figure 16:
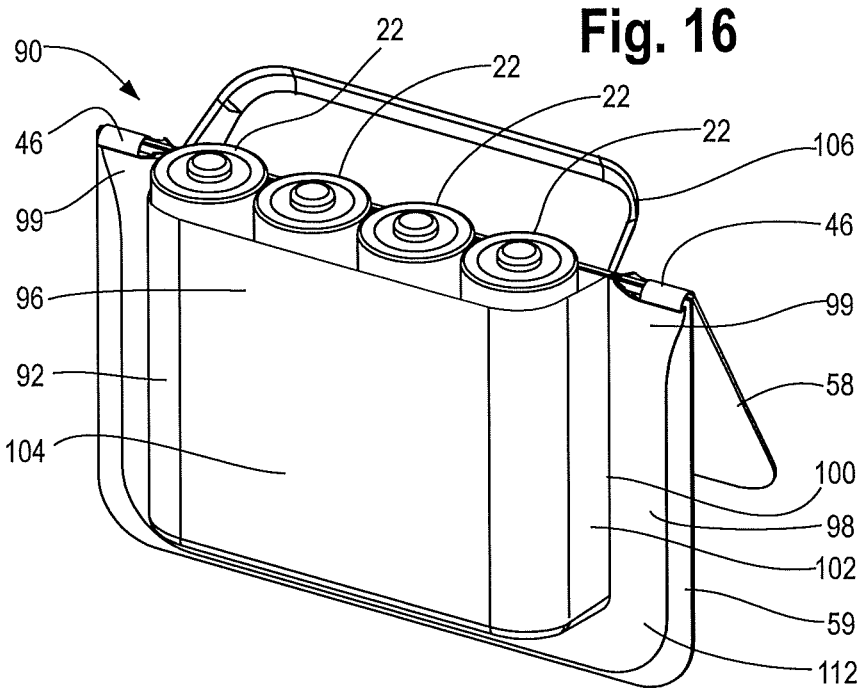
FIG. 16 is a perspective view of the package of FIG. 15.
Figure 19:
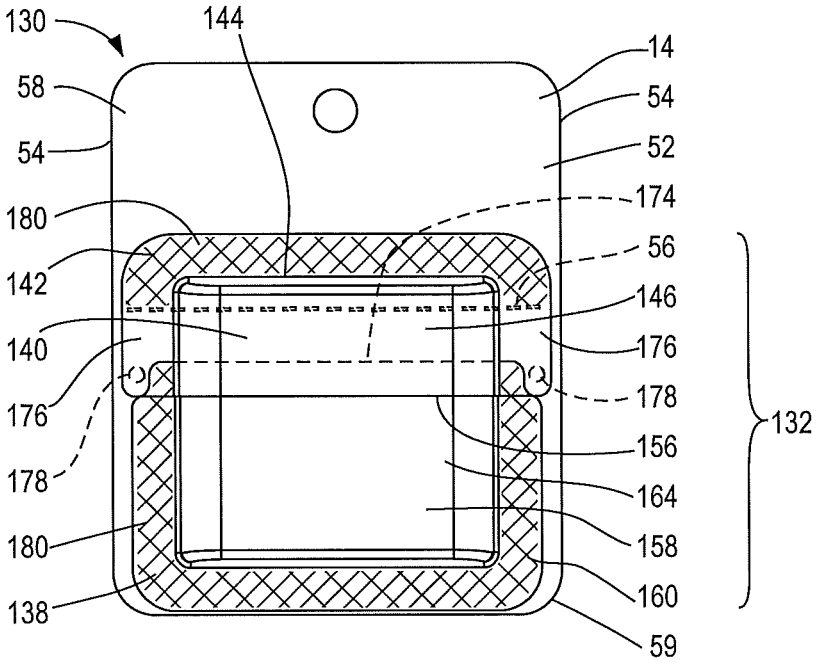
FIG. 19 is a front plan view of a fourth embodiment of a package according to the disclosure.
Figure 20:
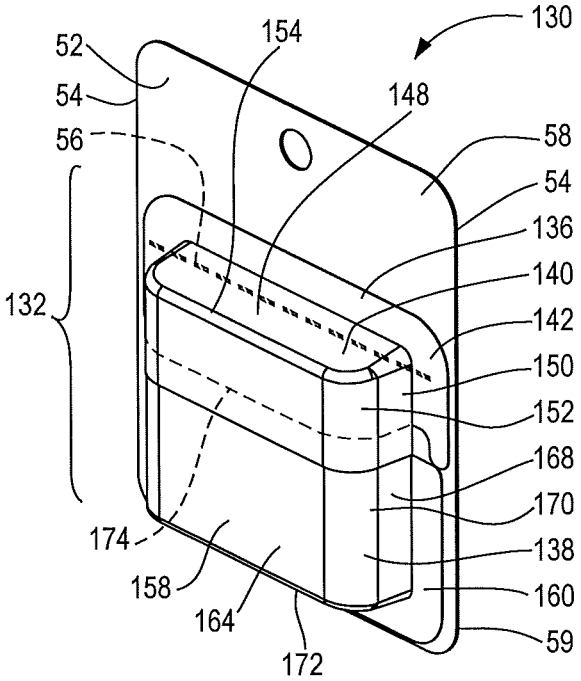
FIG. 20 is a perspective view of the package of FIG. 19.
Figure 21:
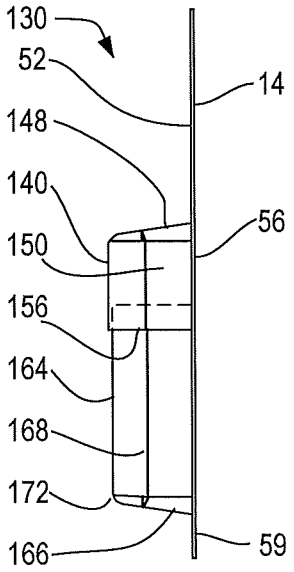
FIG. 21 is a right side view of the package of FIG. 19.
Figure 22:
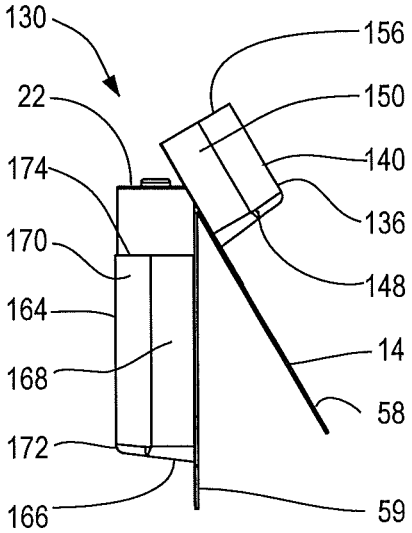
FIG. 22 is a right side view of the package of FIG. 19 shown in an open position.
Figure 23:
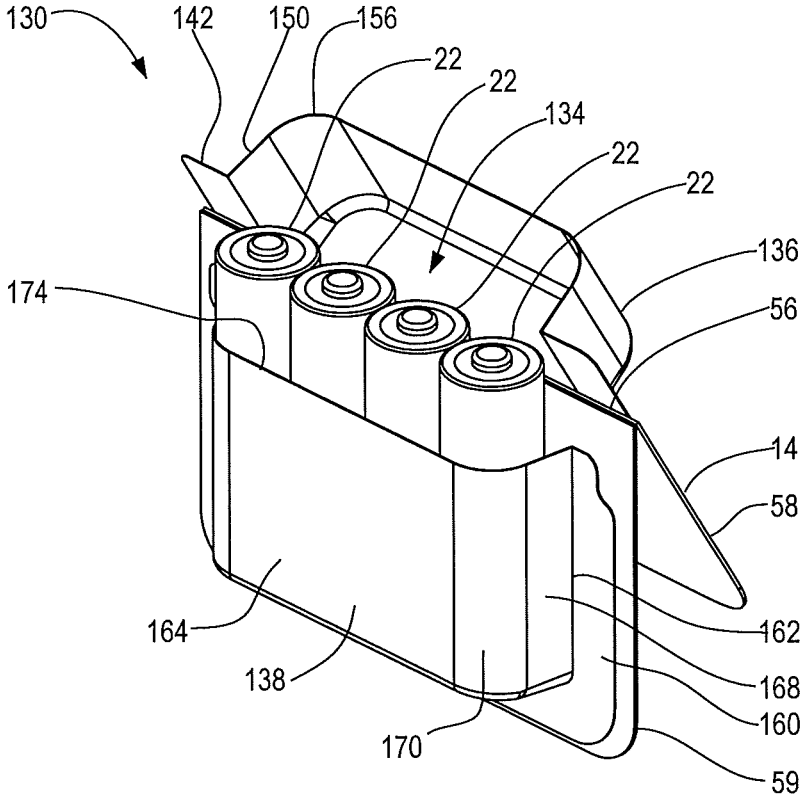
FIG. 23 is a perspective view of the package of FIG. 22.

As will be appreciated, terms such as "above" and "below", "rearward", "outward", "horizontal," "left," "right," "up," "down," "top," "bottom," "front" and "back," and "inward" (etc.), used as nouns, adjectives or adverbs (e.g. "rearwardly", "outwardly", "horizontally, etc.) refer in this description to the orientation of the structure of the package as it is illustrated in the front views, such as FIGS. 1, 11 and 19. For example, "rearward" refers to the direction toward the backing card and "outward" refers to the direction away from the backing card. Such terms are not intended to limit the invention to a particular orientation. Similarly, the terms "lateral" and "longitudinal" generally refer to the orientation of surfaces or other structures relative to an axis of elongation or axis of rotation, as appropriate.

In addition, the terms "front face", "top wall", "sidewalls", "side edges", "bottom wall", "top edge of upper front face" and "bottom edge of lower front face" as applied to the shape of the blisters are for convenience only, and should not be construed as limiting the blisters to any particular shape. Indeed, the blister need not be that well defined. The shape of the blister could be amorphous or any suitable shape, and these features ("front face", "top wall", "sidewalls", etc.) may be undistinguishable.

Finally, like structures may be given the same element number in different embodiments.

A number of embodiments are contemplated. Some embodiments comprise a one piece blister in which the blister flange is not completely cut through, leaving the top and bottom portions of the blister connected along a hinge. Other embodiments comprise a two piece blister in which the entire blister, including the blister flange, is cut completely through, resulting in two separate blister pieces that are mounted to a common backing card.

I. One Piece Blisters

A. Contoured Cut Blister

In a first embodiment shown in FIGS. 1-6, a package 10 comprising a one piece, hinged, thermoformed blister 12 is adhered to a backing card 14. The blister 12 and the backing card 14 together define an interior 134 for holding one or more articles 22 such as the batteries shown in the figures.

The blister 12 comprises a body 16 and a flange 18. The body 16 may be any suitable shape, including one that accommodates the packaging of bulk items or one that conforms to the shape of the packaged articles 22 or that helps secure the articles 22 with minimum movement. For example, in the illustrated embodiment the body 16 is substantially rectilinear and comprises a front face 24, a top wall 28, a bottom wall 29, two sidewalls 30. The sidewalls 30 extend rearwardly from the side edges 26 of the front face 24 toward the backing card 14 and terminate at a body periphery 20 adjacent the flange 18. The top wall 28 extends rearwardly from a top edge 32 of the front face 24 and terminates at the body periphery 20. The bottom wall 29 extends rearwardly from a bottom edge 33 of the front face 24 and terminates at the body periphery 20. In the illustrated embodiment the side edges 26 are rounded to conform to the shape of the cylindrical packaged articles 22, although they may be any suitable shape.

The flange 18 is connected to the body 16 along the periphery 20 and extends laterally away from the body 16, preferably in all four directions (up, down, left and right). In the assembled package 10, the flange 18 is flush with the card 14 and adhered thereto. As explained in more detail below, the flange 18 comprises hinges 46 which connect upper and lower portions 42, 44 of the blister 12. The hinges 46 are located in a same first horizontal plane (P) (see FIG. 6) defined by the card bend line 56. The flange 18 has a width measured from the body periphery 20 to a distal edge 21 of the flange 18 and may comprise a wider area 19 near the cutline 34 to ensure that after the blister 12 is cut there is enough uncut flange 18, accounting for cutting inaccuracies, to hold the blister 12 together before and during sealing to the backing card 14.

The blister 12 comprises a blister upper portion 42 and a blister lower portion 44 separated by the cutline 34 and the hinge 46. The cutline may be made by a laser or other means. The cutline 34 starts and ends at two points located near or on the flange 18 on either lateral side of the body 16 and extends continuously or substantially continuously across the body 16. The cutline 34 may extend completely through the blister body 16 along the sidewalls 30 and the front face 24. Preferably the cutline 34 includes small discontinuities, that is, areas along the body 16 where the blister upper portion 42 and the blister lower portion 44 remain connected in the unopened package 10. In this way the unopened package 10 is more substantial and cannot be opened and re-closed without it being apparent that the package 10 has been opened. Laser cutting is an especially efficient way to create the small discontinuities.

Preferably the cutline 34 does not extend completely across the width of the flange 18, thereby leaving the blister upper portion 42 and the blister lower portion 44 connected along a hinge 46. The hinge 46 holds the blister 12 together as a single piece. The hinge 46 may take various forms or no form. That is, the hinge 46 may be a three-dimensional physical structure such as the formed hinges shown in FIGS. 17 and 18, or the hinge 46 may be a line in the flange 18 that has been weakened or otherwise treated to enable rotational movement, such as a perforated line or an etched line. The hinge 46 may also be simply an area of uncut flange 18 left to hold the blister upper and lower portions 42, 44 together while allowing rotational movement.

The cutline 34 is contoured, that is, the cutline 34 does not lie within a single plane as would be necessary with a Guillotine cut. Rather, some part or parts of the cutline 34, typically the second segments 38 and/or third segments 40, are located outside of the first horizontal plane (P). The cutline 34 preferably extends below the first horizontal plane (P) as described more fully below, but it also may extend above the first horizontal plane (P) or even cross back and forth above and below the first horizontal plane (P).

Laser cutting is an especially efficient way to create the contoured cutline 34. For example, in the illustrated embodiment shown in FIGS. 1-6, the cutline 34 includes two co-linear first segments 36 that extend from two end points 35 on the flange 18 to the body periphery 20, two curved second segments 38 that extend outwardly and downwardly along the sidewalls 30 to the front face 24, and a third segment 40 extending horizontally across the front face 24 and connecting the second segments 38. The second segments 38 along the sidewalls 30 and the third segment 40 along the front face 24 may be curved, straight, zig-zagged, wavy or any suitable shape. The first segments 36 and the third segment 40 do not fall within the same horizontal plane (a plane perpendicular to the flange 18 and backing card 14).

Preferably the first segments 36, and thus the two end points 35 of the cutline 34, lie within the same first horizontal plane (P) as a bend line 56 on the backing card 14, near or just slightly below the tops of the articles 22. Preferably the third segment 40 is located below the first horizontal plane (P) and farther down from the tops of the packaged articles 22 than the first segments 36 to better expose the articles 22 so they can be grasped when the package 10 is opened.

The cutline 34 functions as a separation line for the blister 12 when the package 10 is opened, separating the blister 12 into a blister upper portion 42 and a blister lower portion 44 and the flange 18 into a flange upper portion 48 and a flange lower portion 50.

Figure 26:
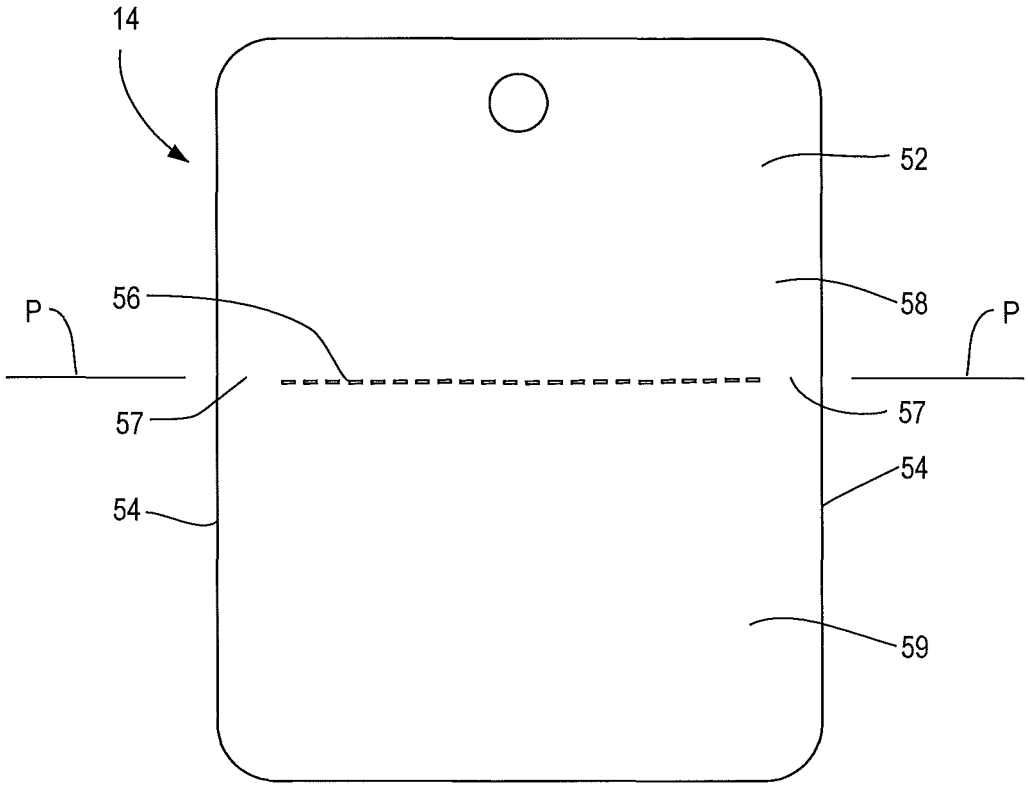
FIG. 26 is a front view of a backing card.

A representative backing card 14 is shown in FIG. 26. The card 14 may be paper based and has a front surface 52 on which the blister 12 is mounted and side edges 54. The card 14 has a bend line 56 created by creasing, scoring, cutting, perforating or otherwise weakening the card 14 along a straight line.

Alternatively, the bend line 56 may be simply a natural bend line, that is, an area along the backing card 14 adjacent the blister hinge 46 which is sufficiently supple (non-stiff) to allow rotational movement (bending) of the card 14. This is most likely to be the case if the blister hinge 46 lies in the same direction as the card grain.

Preferably the bend line 56 is a physical feature such as a scored or perforated line. However, the bend line 56 may simply be a linear weakened area on the backing card 14 around which the backing card will readily bend or pivot.

Preferably the bend line 56 extends part way from one side edge 54 to an opposite side edge 54, leaving an unweakened section 57 between the bend line 56 and each side edge 54. Alternatively, the bend line 56 may extend all the way from one side edge 54 to an opposite side edge 54. The bend line 56 separates the card 14 into an upper portion 58 and a lower portion 59. The card 14 can be bent along the bend line 56 between a planar closed position like that shown in FIG. 3 and an open position that provides access to the articles 22 like that shown in FIG. 6.

As noted above, the bend line 56 and the backing card 14 define a first horizontal plane (P), which is the plane passing through the bend line 56 perpendicular to the plane of the unfolded backing card 14. (In FIG. 26 the first horizontal plane (P) is the plane passing through the bend line 56 normal to the plane of the paper.)

Preferably the bend line 56 is located near or just slightly below the tops of the articles 22 so that the articles 22 do not interfere with the blister upper portion 42 when the package 10 is opened. Preferably the linear first segments 36 of the cutline 34 (along the flange 18) are aligned with the card bend line 56, near the top of the package articles 22.

Assembling the Package

To assemble the package 10, the cut or scored blister 12 can be heat sealed, glued or otherwise affixed to the card 14 so that the portions of the cutline 34 coinciding with the flange 18, i.e., the first segments 36, are aligned with the card bend line 56. The flange upper portion 48 should be glued or otherwise adhered to the card upper portion 58, above the bend line 56, while the flange lower portion 50 should be glued or otherwise affixed to the card lower portion 59, below the bend line 56.

Opening the Package

To open the package 10 the upper portion 58 of the card 14 is bent or rotated backward, away from the blister 12. This causes the blister upper portion 42 to rotate backward along the bend line 56. (In the right side views shown in FIGS. 3-5 the blister upper portion 42 rotates clockwise.) A bottom edge of the blister upper portion 42 will move up and over the articles 22, providing access to the articles 22 while minimizing or eliminating interference between the blister 12 and the packaged articles 22.

B. Planar Cut—Domed Blister

In another embodiment shown in FIGS. 7-10, a package 60 comprises a one piece blister 62 and a backing card 14. The blister 62 and the backing card 14 together define an interior 134 for holding one or more articles 84 such as the electric shaver shown in the figures. The blister 62 is cut into an upper portion 76 and a lower portion 78 by a planar cutline 64. The card bend line 56 and the cutline 64 are located lower down from the top of the article 84 than the bend line 56 and the first segments 36 of the cutline 34 in the previous embodiment, but the blister front face 74 is domed so that the article 84 does not interfere with the blister upper portion 76 when the package 60 is opened.

Like in the previous embodiment, the blister 62 comprises a body 66 and a flange 68 extending laterally away from a periphery 70 of the body 66 in all four directions. The body 66 comprises a front face 74 having side edges 75 and sidewalls 72 extending rearwardly from the side edges 75 and terminating at the body periphery 70. The body 66 also comprises a top wall 65 extending rearwardly from a top edge 67 of the front face 74 to the body periphery 70 and a bottom wall 71 extending rearwardly from a bottom edge 73 of the front face 74 to the body periphery 70.

As noted above, the blister 62 is cut along a planar cutline 64, such as by a guillotine cut, into a blister upper portion 76 and a blister lower portion 78 connected along hinges 46. The plane of the cutline 64 may be orthogonal to the plane of the flange 68. The two blister portions 76, 78 are connected at the flange 68 on either lateral side of the body 66. For example, the blister upper portion 76 and the blister lower portion 78 may be connected along a hinge 46, such as the formed hinges 114, 120 described below with respect to FIGS. 17 and 18. The partially cut flange 68 may comprise a wider area 69 near the cutline 64 to ensure that after the blister 62 is cut there is enough uncut flange 68 to hold the blister 62 together.

As in the previous embodiment, the cutline 64 functions as a separation line for the blister 62 when the package 60 is opened, separating the blister 62 into the blister upper portion 76 and the blister lower portion 78 and the flange 68 into a flange upper portion 80 and a flange lower portion 82.

The blister 62 is mounted to the front surface 52 of the backing card 14 with glue or by other means, and is affixed to the card 14 so that the portions of the cutline 64 lying within the flange 68 are aligned with the card bend line 56. The flange upper portion 80 should be glued or otherwise adhered to the card upper portion 58, above the bend line 56, while the flange lower portion 82 should be glued or otherwise adhered to the card lower portion 59, below the bend line 56.

In this embodiment the blister body 66 is domed to provide clearance between the body front face 74 and the article(s) 84 when the package 60 is opened. For example, the body front face 74 may comprise a first area 86 relatively closer to the backing card 14 and article(s) 84 and a domed area 88 relatively farther from the backing card 14 and article(s) 84. The domed area 88 may straddle the cutline 64 and is designed to accommodate the contours of the packaged article 84 as well as to avoid interference between the article 84 and the blister 62 when the package 60 is opened.

C. Planar Cut—Close Contoured Front

In another embodiment shown in FIGS. 11-16, a package 90 comprises a one piece blister 92 attached to a foldable backing card 14. The blister 92 is cut into an upper portion 106 and a lower portion 108 by a planar cutline 94. The backing card 14 may be of a construction similar to that in the other embodiments. The card 14 can be bent along the bend line 56 between a planar closed position and an open position that provides access to the articles 22. The bend line 56 serves as the axis of rotation of the blister upper portion 106 and the card upper portion 58. Preferably the bend line 56, like the cutline 94, is located near (that is, slightly above, slightly below or aligned with) the tops of the articles 22 so the articles 22 do not interfere with the blister upper portion 106 when the package 90 is opened and closed.

In the illustrated embodiment the blister 92 comprises a closely contoured body 96 and a planar flange 98 extending laterally in all directions away from a periphery 100 of the body 96. The body 96 comprises a front face 104, sidewalls 102, a top wall 105 and a bottom wall 107. The sidewalls 102, top wall 105 and bottom wall 107 extend rearwardly from the front face 104 and terminate at the body periphery 100.

As noted above, the blister 92 is cut along a planar cutline 94, such as by a guillotine cut, into two connected portions, a blister upper portion 106 and a blister lower portion 108. The plane of the cutline 94 is orthogonal to the plane of the flange 98 and the backing card 14 in the unopened package 90.

The two blister portions 106, 108 are connected at the flange 98 on either lateral side of the body 96. For example, the blister upper portion 106 and the blister lower portion 108 may be connected along a hinge 46, such as the formed hinges described below with respect to FIGS. 17 and 18. The partially cut flange 98 may comprise a wider area 99 along the cutline 94 to ensure that after the blister 92 is cut there is enough uncut flange 98 to hold the blister 92 together The cutline 94 may extend completely through the body 96. As in the previous embodiments, the cutline 94 functions as a separation line for the blister 92 when the package 90 is opened, separating the blister 92 into the blister upper portion 106 and the blister lower portion 108 and the flange 98 into a flange upper portion 110 and a flange lower portion 112.

The blister 92 is mounted to the backing card 14 with glue or by other means, and is affixed to the backing card 14 so that the portions of the cutline 94 lying within the flange 98 are aligned with the card bend line 56. The flange upper portion 110 may be affixed to the card upper portion 58, above the bend line 56, while the flange lower portion 112 may be affixed to the card lower portion 59, below the bend line 56.

Curved Flanges

It is anticipated that the blisters described above may comprise curved, non-planar flanges that seal to curved backing cards, for example, backing cards pressed into a curved shape during the sealing process and then held curved by the curved flange. It is intended that the invention described and claimed herein include such embodiments.

Formed Hinges

Figure 17:
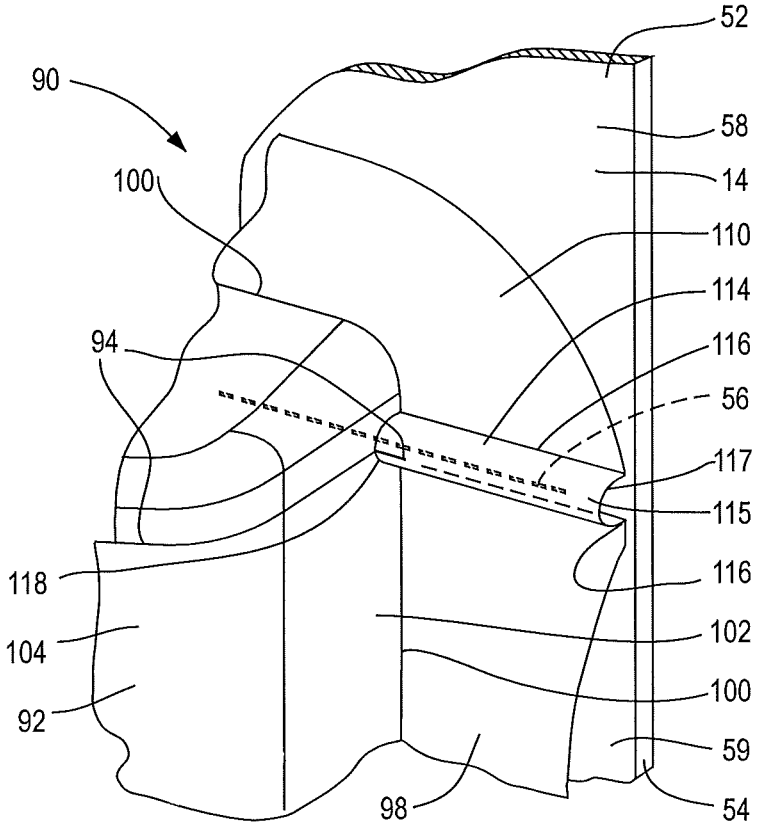
FIG. 17 is a close up perspective view of a portion of a package according to the disclosure.
Figure 18:
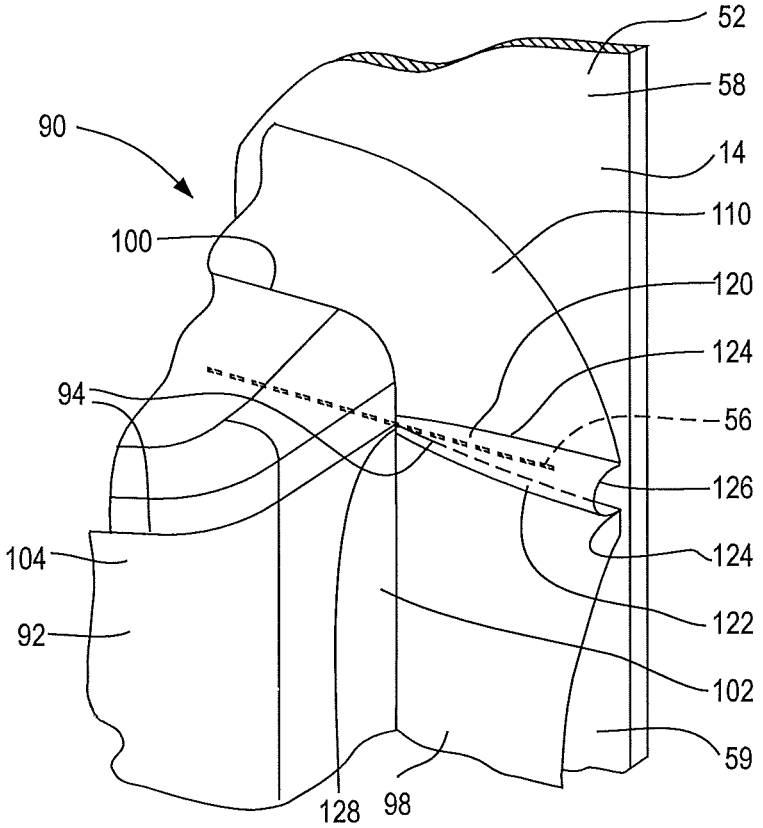
FIG. 18 is a close up perspective view of a portion of a package similar to that of FIG. 12.

As noted above with respect to the one piece blister embodiments, the flange may comprise a formed hinge on either lateral side of the blister body along the axis of rotation of the upper portion of the blister. The formed hinge is configured to allow the blister to rotate more freely about the bend line. The formed hinge may be rounded, rectangular (cut with straight sides and cornered end mills) or any suitable three-dimensional shape. FIGS. 17 and 18 are close up views of two possible formed hinges.

Referring now to FIG. 17, the flange 98 comprises a formed hinge 114 coincident with the cutline 94 and overlaying the card bend line 56. The formed hinge 114 is contoured to create extra surface area forward of the flange 98. This extra surface area is used to cover the separation distance created when the blister upper portion 106 rotates backward along the bend line 56. The formed hinge 114 has a contoured hinge body 115 located outwardly from the flange 98, two longitudinal edges 116, a first end 117 and a second end 118. The two longitudinal edges 116 are coincident with—lie along the same plane as—the flange 98. The first end 117 is a free end located outwardly from the flange 98 and conforms to the shape of the contoured hinge body 115. The second end 118 may also conform to the shape of the hinge body 115 and is attached to the blister body sidewall 102.

It is contemplated that the interface of the formed hinge 114 and the blister sidewall 102 in FIG. 17 might resist or restrict the flexure of the formed hinge 114. Accordingly, and referring now to FIG. 18, a tapered formed hinge 120 may be provided that reduces the three-dimensional contour of the formed hinge 120 at the blister sidewall 102 to a small area or point. The tapered formed hinge 120 has a tapered body 122, two longitudinal edges 124, a first end 126 and a second end 128. The tapered hinge body 122 is located outwardly from the plane of the flange 98 and tapers from the first end 126 down to the smaller second end 128. The two longitudinal edges 124 are coincident with the flange 98 and may converge in the direction of the body sidewall 102 as shown in the figure or remain parallel to each other. The tapered body 122 may taper until it converges at flange level with the rest of the flange 98.

II. Two Piece Blister

In the embodiment shown in FIGS. 19-25, a package 130 is shown comprising a two piece blister 132 affixed to a backing card 14. The two piece blister 132 and the backing card 14 together define an interior 134 for holding one or more articles 22 such as the batteries shown in the figures.

Figure 24:
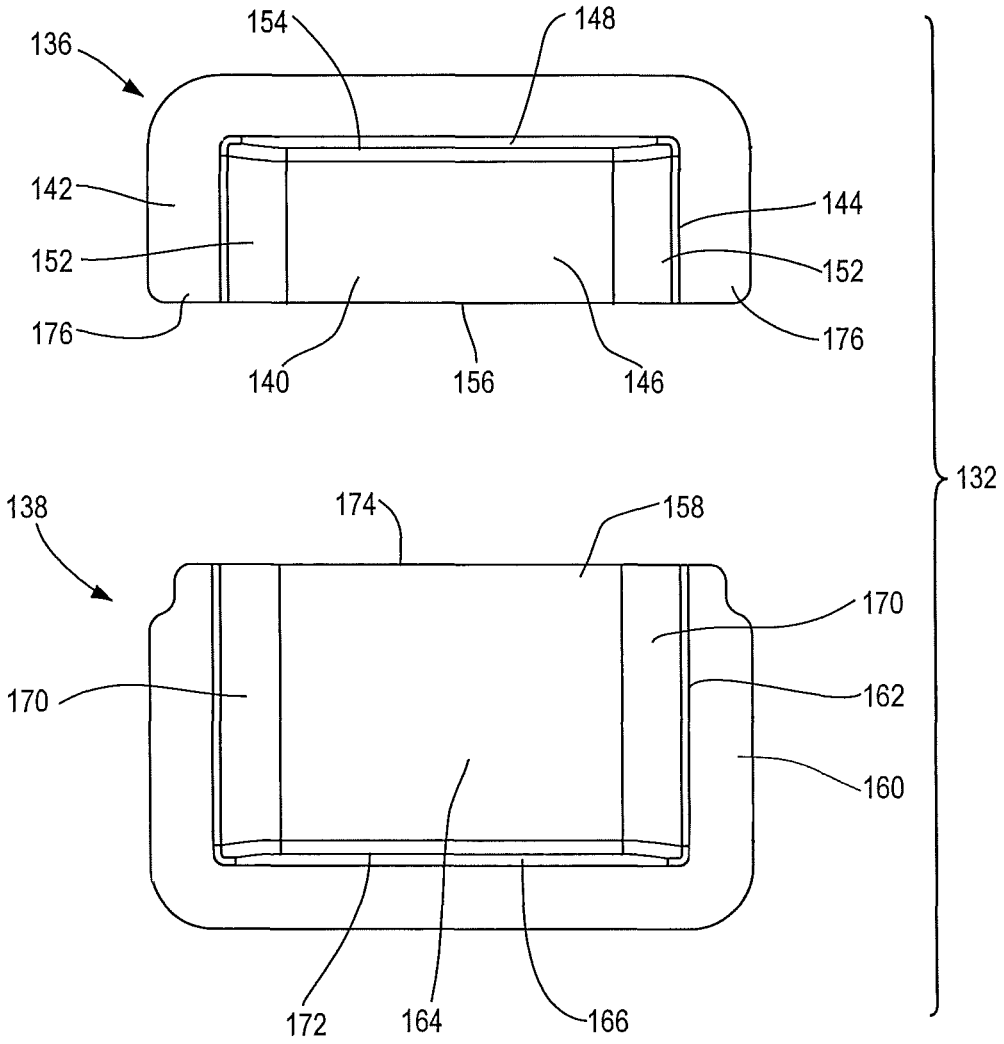
FIG. 24 is a front view of the two piece blister used in the package of FIGS. 19-23.

FIG. 24 is a front view of the two piece blister 132 used in the package of FIGS. 19-23. The blister 132 may be cut along a plane by a guillotine cut as shown in the figures or cut along a contour into two physically separate pieces, a blister upper piece 136 and a blister lower piece 138. The blister upper piece 136 and the blister lower piece 138 may be positioned on the backing card 14, preferably in overlapping fashion, with the top edge 174 of the blister lower piece 138 being above the bottom edge 156 of the blister upper piece 136 to more completely enclose the packaged articles 22.

The assembled blister 132 may conform to the shape of the one or more articles 22 contained within the package 130. However, it should be understood that the blister 132 may be any suitable shape from a rectangular shape for holding screws or other small articles to an amorphous shape that helps secure or capture the packaged article(s).

The blister upper piece 136 comprises an upper body 140 and an upper flange 142. The upper body 140 has an upper periphery 144 adjacent the backing card 14. The upper body 140 comprises an upper front face 146, a top wall 148 and two upper sidewalls 150 connected to the upper front face 146 along upper side edges 152. In the illustrated embodiment the upper side edges 152 are rounded to conform to the shape of the packaged articles 22. The two upper sidewalls 150 extend rearwardly from the two upper side edges 152 and terminate at the upper body periphery 144. The top wall 148 extends rearwardly from a top edge 154 of the upper front face 146 and terminates at the upper body periphery 144. The blister upper piece 136 has a free (unattached) bottom edge 156. The upper flange 142 is connected to the upper body 140 along the upper body periphery 144 and extends laterally away from the upper body 140, flush with the card 14. As best shown in FIG. 24, the upper flange 142 may share the same bottom edge 156 with the upper body 140.

In somewhat similar fashion, the lower piece 138 comprises a lower body 158 and a lower flange 160. The lower body 158 has a lower periphery 162 adjacent the card 14. The lower body 158 comprises a lower front face 164, a bottom wall 166 connected to the lower front face 164 along a lower bottom edge 172 and two lower sidewalls 168 connected to the lower front face 164 along lower side edges 170. In the illustrated embodiment the lower side edges 170 are rounded to conform to the shape of the packaged articles 22. The bottom wall 166 extends rearwardly from the lower front face 164 and terminates at the lower body periphery 162. The two lower sidewalls 168 extend rearwardly from the two lower side edges 170 and terminate at the lower body periphery 162. The lower piece 138 has a top edge 174. The lower flange 160 is connected to the lower body 158 along the lower periphery 162 and extends laterally and orthogonally away from the lower body 158, flush with the card 14. As perhaps best shown in FIG. 24 the lower flange 160 may share the same top edge 174 with the lower body 158.

Alternatively, instead of overlapping, the blister upper piece 136 and the blister lower piece 138 may abut each other. For example, the bottom edge 156 of the upper piece 136 may abut the top edge 174 of the lower piece 138. In still another alternative, the blister upper piece 136 and the blister lower piece 138 may be spaced apart, leaving a gap between the bottom edge 156 of the upper piece 136 and the top edge 174 of the lower piece 138.

Preferably, if the first horizontal plane (P) defined by the bend line 56 is above the top edge 174 of the lower piece 138, there is a gap in the sealed areas 180 between the bend line 56 and the blister lower piece 138. This creates a two dimensional area of weakness in the package 130, as opposed to a one dimensional line of weakness. Therefore it is preferred that the backing card 14 have a physical bend line 56 created by creasing, scoring, cutting, perforating or otherwise weakening the card 14 along a straight line to dictate where the package 130 will bend during opening.

FIG. 26 is a front view of the backing card 14. The card 14 has front surface 52 and a bend line 56 preferably created by creasing, cutting, perforating or otherwise weakening the card 14 along a straight line. The bend line 56 defines an axis of rotation and separates the card 14 into an upper portion 58 and a lower portion 59. Preferably the bend line 56 is aligned with the grain direction of the card 14. Otherwise, the card 14 can break or fold between the bend line 56 and the side edges 54 in a non-linear fashion, off the axis defined by the bend line 56.

Referring now to FIGS. 19-23, preferably the bend line 56, and thus the first horizontal plane (P), is located near the top of the one or more articles 22 so that the articles 22 do not interfere with the blister upper piece 136 when it is rotated open.

Preferably the bend line 56 does not extend all the way across the card 14 from one side edge 54 to the other side edge 54, thereby maintaining the integrity of the card 14, especially prior to opening. That is, preferably the backing card 14 comprises unweakened areas 57 along the axis of rotation between the bend line 56 and the side edges 54. Opening the package 130 requires bending the card 14 along the bend line 56 as well along the unweakened areas 57 of the backing card 14 between the bend line 56 and the side edges 54. A crease or fold along the portions of the backing card 14 between the bend line 56 and the side edges 54 can indicate that the package 130 has been opened.

Assembling the Package

To assemble the package 130, both the upper piece 136 and the lower piece 138 are heat sealed, glued or otherwise affixed to the card 14 along their respective flanges. The upper flange 142 of the upper piece 136 is affixed to the upper portion 58 of the card 14 and the lower flange 160 of the lower piece 138 is affixed to the lower portion 59 of the card 14. The two pieces 136, 138 may overlap as shown in the figures, with the top edge 174 of the lower piece 138 located below the bend line 56 of the card 14 and below the top(s) of the article(s) 22, and the bottom edge 156 of the upper piece 136 located at or below the top edge 174 of the lower piece 138, leaving the bottom edge 156 of the upper piece 136 below the bend line 56.

The upper flange 142 may include downwardly extending areas 176 located below the bend line 56 that are either not adhered to the card 14 or are adhered in such a way (such as with a tack seal 178) that the downwardly extending areas 176 can easily release from the card 14 when the upper piece 136 is bent backward during opening. The upper flange 142 and the lower flange 160 are otherwise adhered to the card 14 along a plurality of sealed areas 180 (shown in cross hatching in FIG. 19).

As previously noted, the blister upper piece 136 and blister lower piece 138 can fit together in overlapping fashion by sliding the pieces 136, 138 together before they are affixed to the card 14. Preferably the blister lower piece 138 is sandwiched between the upper piece 136 and the card 14 in those areas where the two blister pieces 136, 138 overlap. In this way the upper piece 136 is free to move when the package 130 is opened.

Optional Lobes

Figure 25:
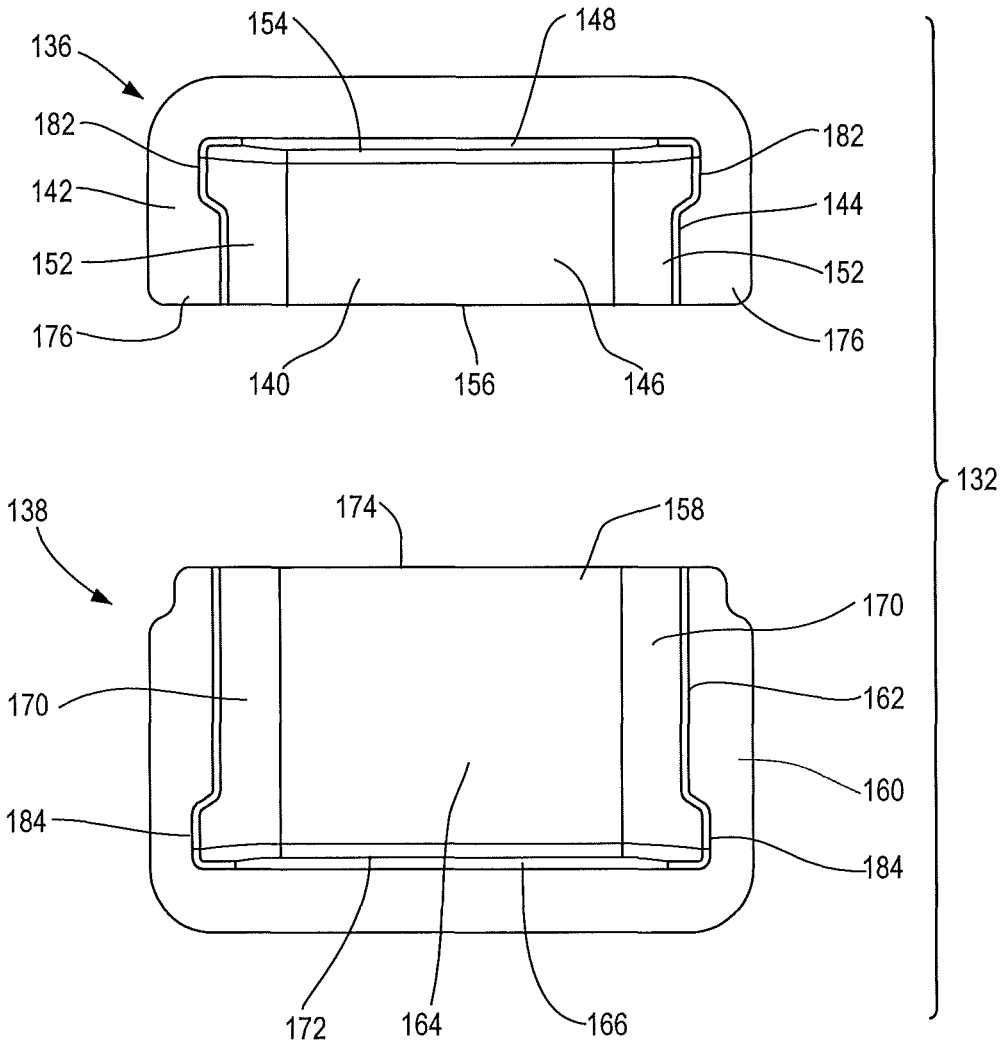
FIG. 25 is a front view of a two piece blister like the kind used in the package of FIGS. 19-23 with lobes added.

In the two piece design it may be difficult to hold the two pieces 136, 138 stationary relative to each other as they are glued or otherwise affixed to the card 14. To address this concern, the upper body periphery 144 may comprise laterally extending upper lobes 182 and the lower body periphery may comprise laterally extending lower lobes 184 as shown in FIG. 25 to help locate the two pieces 136, 138 in a nesting tray while the pieces 136, 138 are being affixed to the card 14.

Opening the Package

To open the package 130 the upper portion 58 of the card 14 is bent backward. This breaks the tack seals 178, if present, and causes the blister upper piece 136, which is permanently adhered to the upper portion 58 of the card 14 at seal areas 180, to rotate backward along the bend line 56. The bottom edge 156 of the upper piece 136 will move up and away from articles 22, providing access to the articles 22.

INDUSTRIAL APPLICABILITY

The package may be used to hold one or more articles while allowing easy access to the article(s). The package is especially useful in applications where multiple articles are sold in a single package but fewer than all the articles are needed at any one time. The packaged articles may be any suitable product, including batteries, pins, nuts, bolts, pens and other items.

The embodiments described above are only particular examples which serve to illustrate the principles of the invention. Modifications and alternative embodiments are contemplated which do not depart from the scope of the invention as defined by the foregoing teachings and appended claims. It is intended that the claims cover all such modifications and alternative embodiments that fall within their scope.

The invention claimed is:

1. A package for holding one or more articles, each of the one or more articles having a top, the package comprising:

a backing card having a front surface, two side edges and a bend line defining an axis of rotation and a first horizontal plane (P) and separating the backing card into a card upper portion and a card lower portion; and a two piece blister adhered to the backing card and comprising a blister upper piece and a separate blister lower piece, the blister and the backing card configured to hold one or more articles; wherein the blister upper piece comprises an upper body and an upper flange, the upper body having an upper periphery adjacent the backing card, the blister upper piece having a free bottom edge, the upper flange connected to the upper body along the upper periphery and extending laterally away from the upper body;

the upper flange is permanently affixed to the card upper portion above the bend line and is releasably adhered to the card lower portion below the bend line;

the blister and the backing card defining an interior for holding the articles; and the backing card is bendable along the bend line between a planar position in which the package is closed and a bent position in which the package is open to provide access to the one or more articles.

2. A packaging system comprising:

the package of claim 1; and one or more articles disposed within the interior, each of the one or more articles having a top; wherein the bend line is located near the tops of each of the one or more articles.

3. The package of claim 1 wherein:

the blister lower piece comprises a lower body and a lower flange, the lower body having a lower periphery adjacent the backing card, the lower piece having a free top edge, the lower flange connected to the lower body along the lower periphery and extending laterally away from the lower body.

4. The package of claim 3 wherein:

the top edge of the blister lower piece is located below the bend line.

5. The package of claim 1 wherein:

the upper body periphery comprises laterally extending upper lobes and the lower body periphery comprises laterally extending lower lobes.

6. The package of claim 3 wherein:

the blister upper piece and the blister lower piece are positioned on the backing card in overlapping fashion so that the entire top edge of the blister lower piece located higher up on the backing card than the entire bottom edge of the blister upper piece.

7. The package of claim 3 wherein:

the blister upper piece and the blister lower piece are positioned on the backing card in abutting fashion, with the top edge of the blister lower piece abutting the bottom edge of the blister upper piece.

8. The package of claim 3 wherein:

the blister upper piece and the blister lower piece are positioned on the backing card in spaced apart fashion, the bottom edge of the upper piece and the top edge of the lower piece defining a gap therebetween.

9. A packaging system comprising:

the package of claim 1; and one or more articles disposed within the interior, each of the one or more articles having a top; wherein the two-piece blister conforms to the shape of the one or more articles contained within the package.

10. The package of claim 1 wherein:

the upper flange is adhered to the backing card along a plurality of first sealed areas and the lower flange is adhered to the backing card along a plurality of second sealed areas.

11. The package of claim 10 wherein:

the second sealed areas are spaced apart from the bend line.

12. The package of claim 1 wherein:

the bend line is aligned with a grain direction of the backing card.

13. The package of claim 1 wherein:

the backing card comprises an unweakened area along the axis of rotation between the bend line and each of the side edges.

* * * * *